United States Patent [19]

Theyse et al.

[11] 4,182,480

[45] Jan. 8, 1980

[54] CENTRIFUGE FOR SEPARATING HELIUM FROM NATURAL GAS

[75] Inventors: Frederik H. Theyse, Bensberg-Herkenrath, Fed. Rep. of Germany; Fridtjof E. T. Kelling, Amsterdam, Netherlands

[73] Assignee: Ultra Centrifuge Nederland N.V., The Hague, Netherlands

[21] Appl. No.: 802,900

[22] Filed: Jun. 2, 1977

[30] Foreign Application Priority Data

Jun. 28, 1976 [NL] Netherlands ..... 7607039

[51] Int. Cl.[2] ..... B04B 5/08

[52] U.S. Cl. ..... 233/27; 233/DIG. 1; 55/203

[58] Field of Search ..... 233/DIG. 1, 1 R, 11, 233/16, 27, 28, 46, 47 R, 24; 55/191, 203

[56] References Cited

U.S. PATENT DOCUMENTS 3,219,265 11/1965 Los et al. ..... 233/DIG. 1

3,501,091 3/1970 Oyana et al. ..... 233/11 X

*Primary Examiner*—George H. Krizmanich

*Attorney, Agent, or Firm*—Cushman, Darby & Cushman

[57] ABSTRACT

Centrifuge for the separation of gaseous mixtures with a rotor inside a housing, comprising a hollow, cylindrical or nearly cylindrical rotorpart also called a separating drum, in which drum a gaseous component may condense as a liquid. This liquid is admitted thereafter through openings in the drum to the space between drum and housing. In this space are formed a sequence of narrow openings, so called restrictors in which the liquid is brought to expansion, returning to gasform.

These restrictors act also as bearings for the drum. The gaseous component that does not liquefy in the drum is drawn off.

23 Claims, 6 Drawing Figures

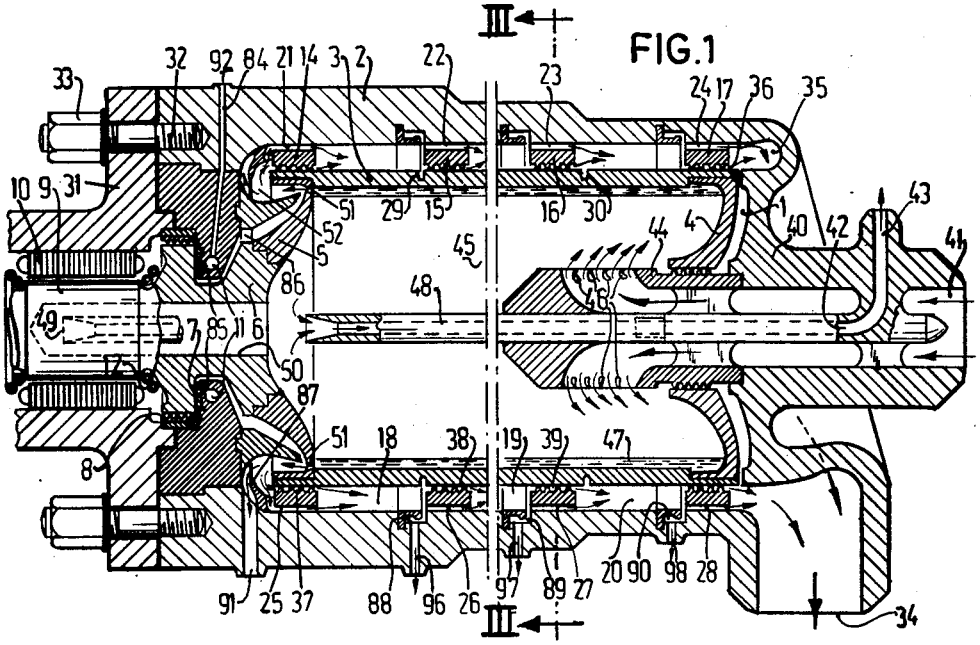
FIG.1
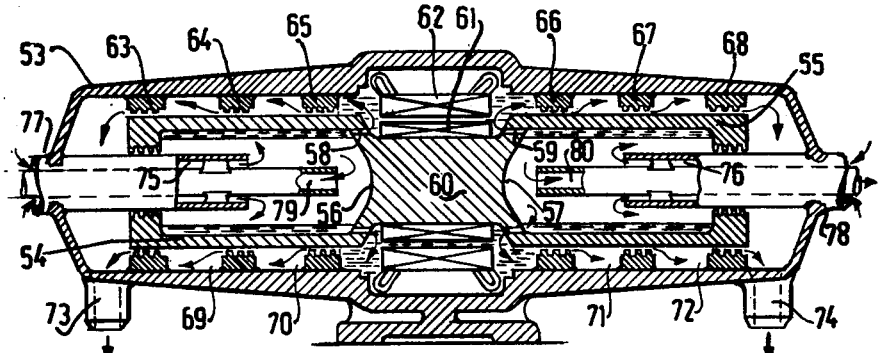
FIG.2
FIG.3
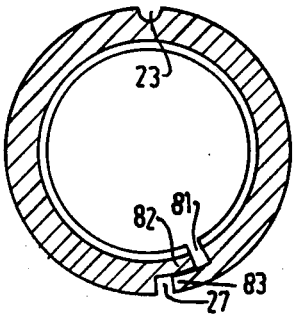

CENTRIFUGE FOR SEPARATING HELIUM FROM NATURAL GAS

The invention relates to a centrifuge for separating gaseous mixtures, comprising at least one hollow, mainly cylindrical rotor part which is rotatable in a housing and designed as a separating drum, which rotor part has at one end an end wall in which openings are provided close to the inside wall of the separating drum, this rotor part being provided with one stationary admission tube for the gaseous mixture to be separated, which admission tube is rigidly fastened to the housing, and with at least one outlet tube for the discharge of a first separation component, which tubes open into a separating chamber situated inside the separating drum, the rotor part being coupled to a driving motor and the centrifuge housing being provided with at least one connection for the discharge of a second separation component.

Such a centrifuge is known from the published Netherlands Pat. No. 103,433.

The application aims at further improving a centrifuge of the type mentioned in the preamble in such a way that it becomes suitable for separating a gas which could occur in very low concentration in vapour or mixtures of vapours. The application specifically aims at separating inert gases, such as helium, from natural gas. For this purpose, according to the invention, the space between the cylindrical outside of the rotor part and the inside of the part of the housing located opposite it, which space will hereinafter be called "expansion slot," is provided with a number of throttling restrictors spaced at regular distances from each other, in such a way that this slot communicates, on the one hand, with the aforementioned openings and, on the other hand, with the connection for the discharge of the second separation component. As a result, the second separation component is removed from the separating chamber through the aforementioned openings, whereupon it is conveyed along the outside of the rotor part, while undergoing a gradual reduction of pressure, to the other rotor end, from where it is received by the aforementioned connection.

During the rotation, condensable gases such as $CH_4$ and higher fractions of the natural gas are so extensively densified under the high concentration of pressure in the centrifuge drum that they liquefy against the inside wall of the drum, where they eventually form a thin layer of liquid. This is also where the heavier impurities become concentrated, such as mercury, nitrogen and the like.

This cannot become a thick layer, since liquid natural gas, which is subject to simultaneous expansion accompanied by partial evaporation, can flow off continuously through the aforementioned openings in the end wall of the separating space towards the space inside the housing but outside the drum. From there, this partly liquid gas flows at a pressure $p_2$ through the first of a series of restrictors which are arranged in the slot, during which process the pressure is relieved to a lower value $p_3$. This is governed by the rule that $p_1/p_2$, just as $p_2/p_3$, is equal to the critical pressure ratio. The gas, although cooling down as a result of expansion during this relief of pressure, is heated at the same time on account of the heat transfer from the layer of liquid natural gas inside the drum, which heat moves through the drum wall of the centrifuge. Eventually, therefore, the temperature in the expansion slot remains substantially constant. This process is repeated at all restrictors except the last. In the last restrictor, the medium in the expansion slot is no longer heated by heat from the layer of liquid natural gas inside the centrifuge drum. This medium leaves the centrifuge after the last expansion.

It is an important aspect of the invention that the throttling restrictors in the expansion slot are designed as a number of bearings which surround the rotor and support it along the entire periphery, mutually separated by expansion chambers. The drum is thus adequately supported from distance to distance over the entire length of the drum, so that quiet running of the drum is ensured.

Such a bearing is preferably provided in the form of a gas-film bearing or of a spiral-groove gas bearing, because this enables the second separation component to flow through the spiral-groove passages to the other side of the bearing.

Such a bearing is also designed effectively as a viscoseal.

In order to prevent the possibility of insufficient medium flowing through the lubricant film space of a bearing to the other side, a bearing house is provided, if necessary, with at least one bypass for connecting the front and the rear side of the bearing to each other. The pressure on the outside of the drum is very high at the beginning of the expansion, its maximum being almost as high as in the thin liquid layer inside the drum, but it becomes gradually lower to the measure that more restrictors have been passed. Accordingly, the drum is exposed to a higher outward differential pressure near the inlet of the gas into the drum than near the outlet of the liquid gas as it leaves the drum. The drum will therefore expand more greatly at the inlet end if the wall thickness is kept constant. In order to enable the bearings to follow this rotor-drum deformation, which changes from place to place, a bearing is interrupted on the periphery by a dilation slot, so that the bearing can perform a flexible motion.

With regard to wall thickness, the centrifuge housing can be adapted to the local pressure in the expansion slot, in the sense that the wall thickness increases to the measure that the maximum operating pressure in the expansion slot has a higher value.

According to a preferred embodiment, the outlet tube for the first separation component extends inside the rotor into or near the coolest part thereof. As a result, the first component is drained at a point where the vapour pressure of the second medium is as low as possible, so that the concentration of the inert gas, such as helium, is high for that very reason, allowing the first component to be drained with the highest possible helium enrichment.

It can be advantageous to provide the centrifuge with a two-part rotor, in such a way that those end walls of each rotor part which are furnished with openings face each other, while being connected by a central portion. In such case, the need for a collar bearing to absorb the axial pressure is obviated. This embodiment greatly simplifies the installation of the driving electromotor, since it can be so fitted that its armature coincides with the aforementioned central portion. The stator of such an electromotor is provided as a canned stator, around which the liquid natural gas flows.

In order to avoid trouble from certain critical speeds of the centrifuge drum, it is preferably so manufactured that the drum wall exhibits at regular intervals a constriction in the form of a circular slot along the periphery. Such circular slots can be provided along the inside periphery as well as along the outside periphery. In the places where such a slot-shaped groove occurs, the drum wall is somewhat more flexible, allowing the critical speeds of the rotor drum to be made so low that they are smaller than the operating speed. It is thus made impossible for these frequency ranges to interfere with each other.

The expansion space located outside the separating drum can be provided with means for separate discharge of liquid, so that the expansion slot contains substantially the gaseous second separation pressure separation component, so that the jacket friction on the outside of the centrifuge drum is appreciably reduced. In this embodiment, the bearings which embrace the drum are provided in the form of gas bearings.

In order to load the drum wall more uniformly, the inside diameter of the drum can be made large in an area marked by a high outside pressure, and conversely. As a result, the liquid layer of the first separation component, and therefore the internal load, increases in magnitude in places of a high outside pressure, and decreases in magnitude where the outside pressure is low.

Expansion chambers can also be arranged inside the drum, as will be described hereinafter. This causes the gas pressure to be lowered on the outside of the drum, with a corresponding decrease of the frictional resistance losses.

With the use of several of the centrifuges described, a centrifuge cascade can be so built up that these centrifuges communicate with each other on their gas sides, in such a way that the degree of enrichment of the first component increases at each subsequent centrifuge. The first component can then be abstracted at the top of the cascade, this component containing to a high degree the desired gas, for example helium. This component is then discharged to an installation for burning the entrained residues of the second component, which consists substantially of hydrocarbons, whereupon the resultant gaseous mixture is supplied to an installation for freezing the impurities out of the desired inert gas.

Some forms of embodiment of the invention will now be described in further detail on the basis of the following figures, of which:

FIG. 1 shows a vertical transverse section through a centrifuge according to the invention;

FIG. 2 shows diagrammatically in a vertical transverse section how such a centrifuge installation can be designed in twin form;

FIG. 3 is a vertical transverse section across a bearing shown in FIG. 1;

Figure 4:
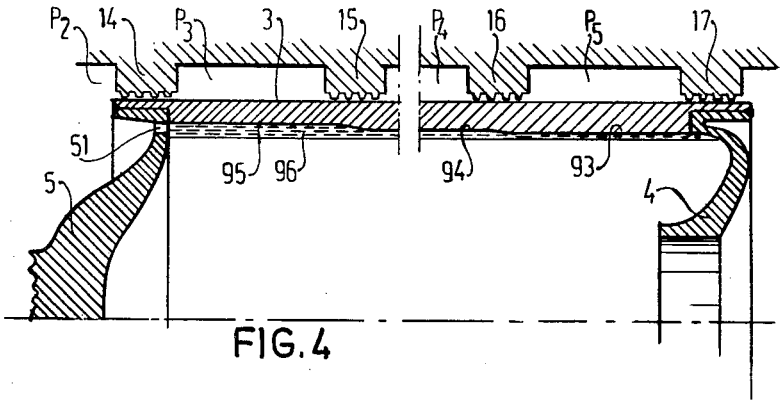
FIG. 4 shows a detail of a drum having different inside diameters.

In FIG. 1, a centrifuge drum 1 is fitted inside the centrifuge housing 2. The drum is formed out of a drum wall 3, which is provided at both ends with end covers 4 and 5. This last cover is welded securely to a hub 6, which extends to the left in a collar bearing 7 as well as a liquid seal 8. An electromotor, of which 9 is the rotor and 10 the stator, is fitted on the other side of this collar bearing. A cooling channel 11 is provided inside the fixed parts of the collar bearing, and cooling channels 12 and 13 are furthermore provided on both sides of the electromotor. The cooling channel 11 can also be used for conveying lubricants to the bearing 7, as shown by FIG. 1. This lubricant preferably consists of the first separation component, which is supplied to the bearing 7 through channel 84 and channels 85. A portion of this flows inside and, after having flown through the space 86, joins the flow of the first separation component in the chamber 52 (see hereafter). Another portion flows through the seal 8, where this lubricant medium is cooled and reduced in pressure, thus passing into vapour, whereupon it cools the motor 9, 10.

The centrifuge drum 3 is supported on the outside in a number of spiral-groove bearings 14 through 17 which are fixed to the inside of the housing 2. These spiral-groove bearings are separated from each other by expansion chambers 18, 19 and 20. The bearings are each provided with a number of bypasses 21 through 28, so that the lubricant medium can move under the influence of the pressure gradient through the bearings from one expansion chamber to the next. The drum wall is provided at regular intervals with circular slots 29, 30, for the purpose of influencing the critical speed favourably. The slots 29, 30 render the wall of the drum 3 locally more flexible than the remaining part of the drum. This lowers the first mode of the critical bending speed, the critical speed induced by the possibility of the rotor to bend elastically outwards. By specifying the number of slots 29, their width and depth, the designer has the means to aim at a critical speed that is outside the operating speed. This will result in quiet running of the drum, without vibrations. After each expansion of the first separation component, the resultant condensate can be discharged separately, as shown at 88, 89 and 90.

The centrifuge is shut off on the left by an end cover 31, which is fixed to the housing by means of stud bolts and nuts 32 and 33, respectively. On the other side of the centrifuge housing is an outlet 34 for the second separation component, such as natural gas, which connects to an annular outlet channel 35, which is arranged beyond the last throttling restrictor 36. The preceding throttling restrictors bear the numbers 37, 38 and 39. The end cover 40 comprises in its centre an admission member 41 for the natural gas to be treated, which end cover also contains an outlet 42 for discharging the discharged first separation component, mainly helium, to the discharge connection 43.

A gas inlet and outlet system 44, which passes through a pipe-end cover 4 of the drum with the use of a labyrynth gland and/or a Holweck seal, connects to the inside of the cover 40. The natural gas enters the separating space 45 through louvres 46, so that it is gradually dispersed over the inside of the drum. As a result of the great increase in pressure towards the inside circumferential surface of the drum, a layer 47 of liquefied natiural gas forms at that surface. However, the helium contained in the natural gas only undergoes a minor increase in pressure, since its specific weight is very low. Accordingly, this helium cannot be liquefied in this manner, but it remains in gaseous form inside the drum, just as the other residual gases. It can thus be drained off through the outlet tube 48. According to a variant, the end 49 of this outlet tube is arranged in an adequately cooled hollow space 50 within the armature of the electromotor, so that the drained first component contains more helium and is less imbued with traces of the second component. The openings 51 in the end cover 5 allow the liquid natural gas to flow from the drum space to the fluid space 52. After the expansion in the openings 51 there also is a separate discharge of the resultant condensate through a liquid separator 87.

This condensate is discharged through the channel 91. A portion of it can be conveyed to the inlet 92 of the lubricant channel 84.

A variant of FIG. 1 is shown in FIG. 2, where two centrifuge drums 54 and 55 are accommodated in a housing 53, in such a way that the end covers 56 and 57, provided with the outlet openings 58 and 59, respectively, each face a central part 60 with which they are integral. The armature 61 of the electromotor, which has a stator 62, is seated on this central part. The numbers 63 through 68 indicate the preferably used gas bearings, which at the same time serve as restrictors, through which expansion of the natural gas is possible. The expansion chambers in this figure bear the numbers 69 through 72. The outlets of the so-called first component (mainly natural gas) are marked 73 and 74, all this in accordance with the descriptions pertaining to FIG. 1. The natural gas which is to be treated is supplied through the outer tubes 75 and 76, respectively, of the two inlet systems 77 and 78. The inner tubes 79 and 80, respectively, of these systems serve to discharge the first component, mainly helium.

FIG. 3 shows in a transverse section along III—III in FIG. 1 how a spiral-groove bearing can be provided with an expansion slot 82/27. This slot is wide at both of its ends, so that these can serve as additional bypasses besides the bypass 23. Also, the ends 82 and 83 can now perform a sliding motion with respect to each other, allowing the inside diameter of the bearing to adapt itself to the outside diameter of the drum and the jacket housing. In a variant of this design, the dilation slot follows one of the helicoid flanks of the spiral-groove bearings so as to restrict short-circuiting of the pressure build-up in the various spiral-grooves.

FIG. 4 shows that the inside drum diameter can increase towards the outlet openings 51. With adapted discharge resistance, therefore, the layer of natural gas at 93 is thin, whereas it is thick at 95 and has an intermediate thickness at 94. The load on the drum portion 95 through the thick liquid layer 119 is high, but this outward load is compensated because the outside pressure $p_3$ in that area is likewise high. Analogously, the drum loads at 94 and 93 are so balanced with respect to each other that $p_5 < p_4 < p_3$.

Figure 5:
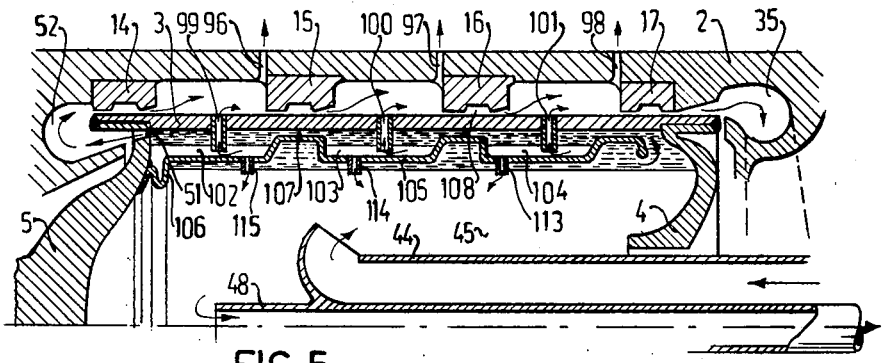
FIG. 5 shows a drum having internal, rotating expansion chambers.

FIG. 5 is a diagrammatic view of a drum where expansion takes place not only in the openings 51, but in openings 99, 100 and 101 as well. Vapour is discharged by these from the expansion chambers 102, 103 and 104, respectively. These chambers are bounded on the inside by a ribbed wall 105, which is flexibly connected to the end wall 5 at 106. These chambers communicate with each other through narrow passages 107 and 108. Small tubes 113, 114 and 115, which protrude through the inner liquid layer, discharge the first separation component from the spaces 102, 103 and 104 to the central portion of the separating chamber 45. The numbers 96, 97 and 98 indicate condensate discharge channels.

Figure 6:
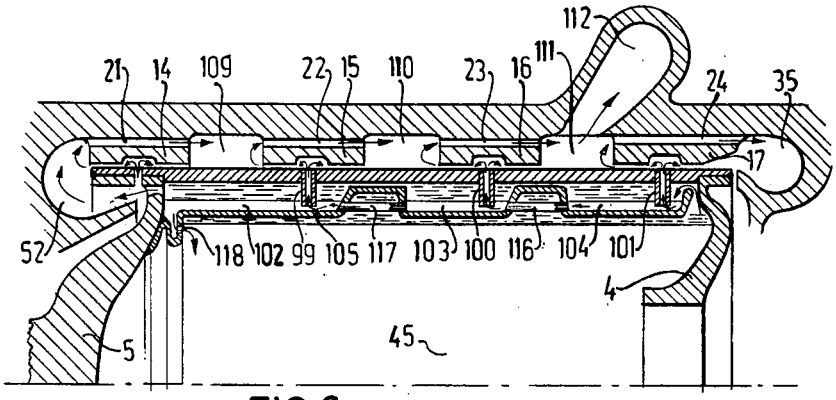
FIG. 6 is a variant of FIG. 5.

FIG. 6 finally shows that the discharge channels 99, 100 and 101 can each open into the centre of the gas bearings 15, 16 and 17, respectively. This embodiment allows the pressure in the spaces 109, 110 and 111 to be further reduced. Most of the gaseous natural gas is now discharged through the bypasses 21 through 24.

According to this design, the discharge of the first separation component from the spaces 103 and 104 takes place through small tubes 116 and 117 which open into the space 102. From there, the separated component can reach the central portion of the separating chamber 45 through a number of openings 118.

The condensate discharge channels are not shown in this figure. It is shown, however, that the discharge capacity for the gaseous second separation component can be increased by providing one additional discharge channel 112. If required, such an additional discharge channel can be provided in the same manner for the chambers 109 and 110. The channels 35 and 112, etc., open into one collecting main, which is not shown.

We claim:

1. Centrifuge for separating gaseous mixtures comprising at least one hollow, cylindrical separator drum which is rotatable about its axis in a housing the separating drum having at one end an end wall in which openings are provided close to the inside wall of the separating drum through which openings a second separation component passes into a space between the drum and the housing, a stationary admission tube for admitting to the drum the gaseous mixture to be separated, said admission tube being rigidly fastened to the housing, at least one outlet tube for discharging a first separation component from the drum, said tubes being open into a separating chamber situated inside the separating drum, a driving motor coupled to the drum, at least one outlet located in the housing for the discharge of the second separation component from the housing, and means forming the space between the drum and the housing into an expansion slot for conveying the second separation component from said openings to said outlet while undergoing a gradual reduction of pressure, said means including a plurality of throttling restrictors.

2. Centrifuge according to claim 1, wherein the wall of the separating drum transmits heat from the inside of this drum to the expansion slot.

3. Centrifuge according to claim 1, wherein said restrictors include bearings which surround the drum and support it along the entire periphery, separated from each other by expansion chambers.

4. Centrifuge according to claim 3, wherein at least one of said bearings is provided in the form of a spiral-groove bearing.

5. Centrifuge according to claim 3, wherein at least one of said bearings is designed as a visco-seal.

6. Centrifuge according to claim 3 wherein at least one of said bearings includes a bearing house which is provided with at least one bypass which connects the front and the rear side of the bearing to each other.

7. Centrifuge according to claim 3 wherein at least one of said bearings is interrupted on the periphery by an expansion slot.

8. Centrifuge according to claim 1, wherein the wall thickness of the housing is adapted to the local pressure in the expansion slot, in the sense that this wall thickness increases to the measure that the maximum operating pressure in this expansion slot increases in this area.

9. Centrifuge according to claim 1, wherein the outlet tube for the first separation component extends inside the drum into or near the coolest part thereof.

10. Centrifuge according to claim 1 wherein there are two drums, those end walls of each drum that are furnished with openings facing each other, and being connected by a central portion.

11. Centrifuge according to claim 10, wherein the central portion is the rotor of an electromotor.

12. Centrifuge according to claim 1, wherein the centrifuge drum wall exhibits at regular intervals a constriction in the form of a circular slot along the periphery.

13. Centrifuge according to claim 1, wherein means for the separate discharge of fluid are arranged in the expansion spaces located outside the separating drum.

14. Centrifuge according to claim 13 wherein at least one bearing located at the end of the drum remote from said openings is provided in the form of a bearing having a gas cushion.

15. Centrifuge according to claim 1, wherein the inside diameter of the separating drum decreases stepwise from the end wall with openings towards the other end wall, in such a way that the thickest layer of the liquid first separation component inside the separating drum occurs in the area of the highest presure in the decompression slot and the thinnest layer of the liquid first separtion component occurs in the area of the lowest pressure in the decompression slot.

16. Centrifuge according to claim 1, wherein the separating drum contains a number of rotating expansion chambers in heat-exchanging contact with the liquid second separation component in the drum.

17. Centrifuge according to claim 16, wherein a rotating expansion chamber communicates in the vapour space above its free liquid level with the space outside the drum through vapour discharge channels.

18. Centrifuge according to claim 16, wherein the rotating expansion chambers are separated from the inner separating space in the drum by an elongated wall which is ribbed in circumferential direction.

19. Centrifuge according to claim 18, wherein the ribbed wall is flexibly connected to at least one end wall.

20. Centrifuge according to claim 17, wherein a discharge channel opens into the centre of a gas bearing.

21. Centrifuge according to claim 16, wherein a rotating expansion chamber communicates with the central space of the separating drum by means of a small tube.

22. Centrifuge according to claim 18, wherein the gas-filled portions of the rotating expansion chambers communicate with each other through small tubes.

23. Centrifuge according to claim 7, wherein the expansion slot follows one of the helicoid spiral-groove flanks.

* * * * *